US007451733B2

(12) United States Patent
Kwack

(10) Patent No.: US 7,451,733 B2
(45) Date of Patent: Nov. 18, 2008

(54) AIR DUCT ORIFICE FOR REDUCING LOW FREQUENCY NOISE

(75) Inventor: Chul Kyu Kwack, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/648,863

(22) Filed: Dec. 29, 2006

(65) Prior Publication Data

US 2008/0035092 A1 Feb. 14, 2008

(30) Foreign Application Priority Data

May 26, 2006 (KR) ..... 10-2006-0047302

(51) Int. Cl.
*F02M 35/12* (2006.01)

(52) U.S. Cl. ..... 123/184.57

(58) Field of Classification Search ..... 123/184.21, 123/184.53, 184.57, 184.59, 184.61
See application file for complete search history.

(56) References Cited

U.S. PATENT DOCUMENTS

| | | | | |
|---|---|---|---|---|
| 4,593,656 | A * | 6/1986 | Shibata et al. | 123/184.47 |
| 4,903,644 | A * | 2/1990 | Groger et al. | 123/184.61 |
| 4,960,096 | A * | 10/1990 | Sukimoto et al. | 123/568.12 |
| 5,253,614 | A * | 10/1993 | Matsuo et al. | 123/184.53 |
| 5,353,752 | A * | 10/1994 | Suzuki | 123/184.61 |
| 6,422,221 | B2 * | 7/2002 | Pietrowski et al. | 123/568.17 |
| 7,080,619 | B2 * | 7/2006 | Kino et al. | 123/184.57 |
| 7,159,557 | B2 * | 1/2007 | Yasuda et al. | 123/184.57 |
| 7,198,017 | B2 * | 4/2007 | Vogt et al. | 123/184.57 |

FOREIGN PATENT DOCUMENTS

| | | |
|---|---|---|
| JP | 55-180964 | 12/1980 |
| KR | 97-41460 | 12/2006 |

* cited by examiner

*Primary Examiner*—Hai H Huynh
(74) *Attorney, Agent, or Firm*—Morgan Lewis & Bockius LLP

(57) ABSTRACT

An air duct orifice includes an adapter pipe inserted in and attached to an end portion of an air duct connected to an engine side; an orifice pipe protruding from an outer surface of the adapter pipe; and an orifice cover coupled to an upper opening formed on the orifice pipe. The orifice pipe is disposed in a receiving opening formed on the air duct. The orifice pipe has engaging jaws on two side surfaces, and the orifice cover has combining holes on two side surfaces. The engaging jaws are engaged with the combining holes. The side surfaces of the orifice pipe without engaging jaws and the side surfaces of the orifice cover without combining holes are spaced apart from each other to form a radiation path of noise. The air duct orifice further includes a small resonator mounted to a lower side surface of the air duct.

8 Claims, 6 Drawing Sheets radiation of discharge noise of an engine a preventive structure of inflow of foreign substance

AIR DUCT ORIFICE FOR REDUCING LOW FREQUENCY NOISE

CROSS-REFERENCE TO RELATED APPLICATIONS

This application claims priority from Korean Patent Application No. 10-2006-0047302, filed on May 26, 2006 with the Korean Intellectual Property Office, the disclosure of which is incorporated herein by reference.

BACKGROUND OF INVENTION

1. Field of Invention

The present invention relates to an air duct orifice, and more particularly, to an air duct orifice for reducing low frequency noise, having a structure by which discharge noise of an engine is transmitted to an engine room and introduction of foreign substances is prevented.

2. Description of the Related Art

Reducing noise in air ducts (also called intake pipes), has become an important focus of study in recent years. An example of an air duct for reducing engine noise is described in Korean utility model publication No. 1997-041460, which discloses a structure in which a protrusion portion having a discharging hole is formed on one side of an intake pipe. This structure is disadvantageous in that foreign substances can enter easily into the structure, and the engine noise reduction effect is insignificant.

As another example, Japanese unexamined utility model publication No. S55-180964 discloses a structure in which a cap for cleaning air is attached to an end of a pipe and an opening is formed on the cap for guiding air flow to the exterior. This structure is advantageous in that noise is discharged and an inflow of water is prevented, however the engine noise blocking effect is insignificant.

As yet another example, a large-capacity resonator has been used to reduce lower frequency engine booming. In the layout aspect, it is unfavorable to install a large resonator of 2.5 liters or more in a narrow space of the engine room and manufacturing costs and weight are increased.

SUMMARY OF THE INVENTION

Exemplary embodiments of the present invention provide an air duct orifice comprising an adapter pipe inserted in and attached to an end portion of an air duct connected to an engine side; an orifice pipe protruding from an outer surface of the adapter pipe; and an orifice cover coupled to an upper opening formed on the orifice pipe.

The air duct may have a receiving opening at an end portion thereof and the orifice pipe may be disposed in the receiving opening.

The orifice pipe may have engaging jaws on two side surfaces thereof, and the orifice cover may have combining holes on two side surfaces thereof, whereby the engaging jaws are engaged with the combining holes.

The side surfaces of the orifice pipe without engaging jaws and the side surfaces of the orifice cover without combining holes may be spaced apart from each other to form a radiation path of discharge noise of the engine.

The air duct orifice may further comprise a small resonator mounted to a lower side surface of the air duct.

BRIEF DESCRIPTION OF THE DRAWINGS

The above and other aspects of the prevent invention will become apparent and more readily appreciated from the following description of the exemplary embodiments, taken in conjunction with the accompanying drawings, in which.

DETAILED DESCRIPTION OF THE PREFERRED EMBODIMENTS

Figure 1:
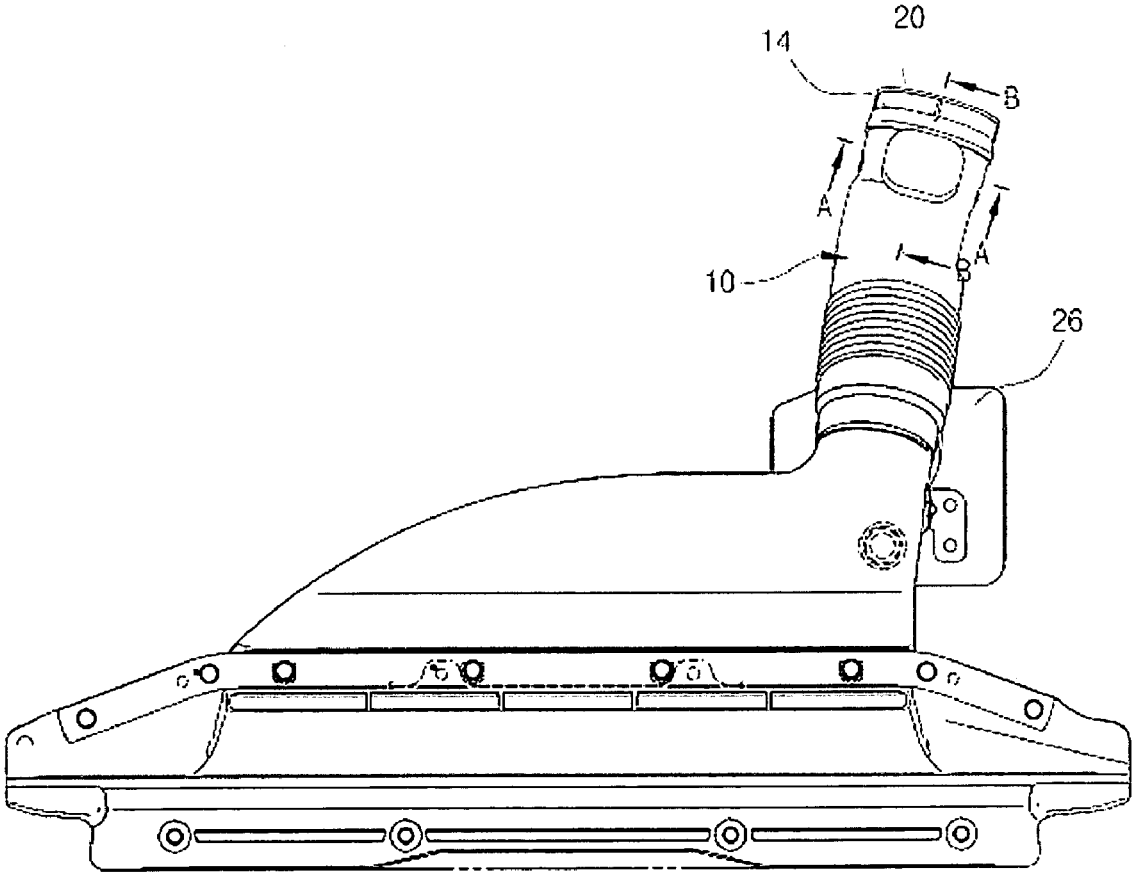
FIG. 1 is a perspective view showing a structure of an air duct orifice for reducing low frequency noise according to the present invention.

Reference will now be made in detail to the preferred embodiments of the present invention, examples of which are illustrated in the accompanying drawings, wherein like reference numerals refer to like elements throughout. The embodiments are described below so as to explain the present invention by referring to the figures.

The present invention provides an orifice pipe 12 at an end portion of an air duct 10 connecting an external air intake port and an engine side.

An adapter pipe 14 having the orifice pipe 12 is inserted in and attached to the air duct 10. The adapter pipe 14 is a hollow cylindrical pipe with orifice pipe 12 protruding from an outer circumferential surface of the adapter pipe 14 such that adapter pipe 14 and orifice pipe 12 are fluidly connected.

Figure 5A:
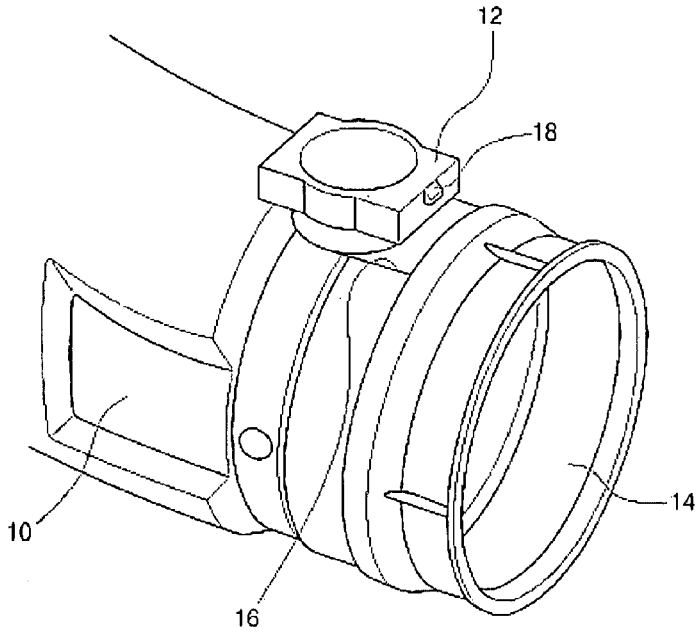
FIG. 5*a* is a perspective view illustrating a combining state between an adapter pipe having an orifice pipe according to the present invention and an air duct.

Referring to FIG. 5*a*, a receiving opening 16 is formed at an end portion of the air duct 10 along an axial direction, such as by removing the corresponding section of the air duct 10. The adapter pipe 14 is inserted in and attached to the air duct 10, such that the orifice pipe 12 is disposed in the receiving opening 16.

An inlet portion of the orifice pipe 12 has the shape of a rectangular flange, and engaging jaws 18 protrude from side surfaces of the inlet portion.

An orifice cover 20, having combining holes 22, is coupled to an upper opening portion of the orifice pipe 12.

Figure 5B:
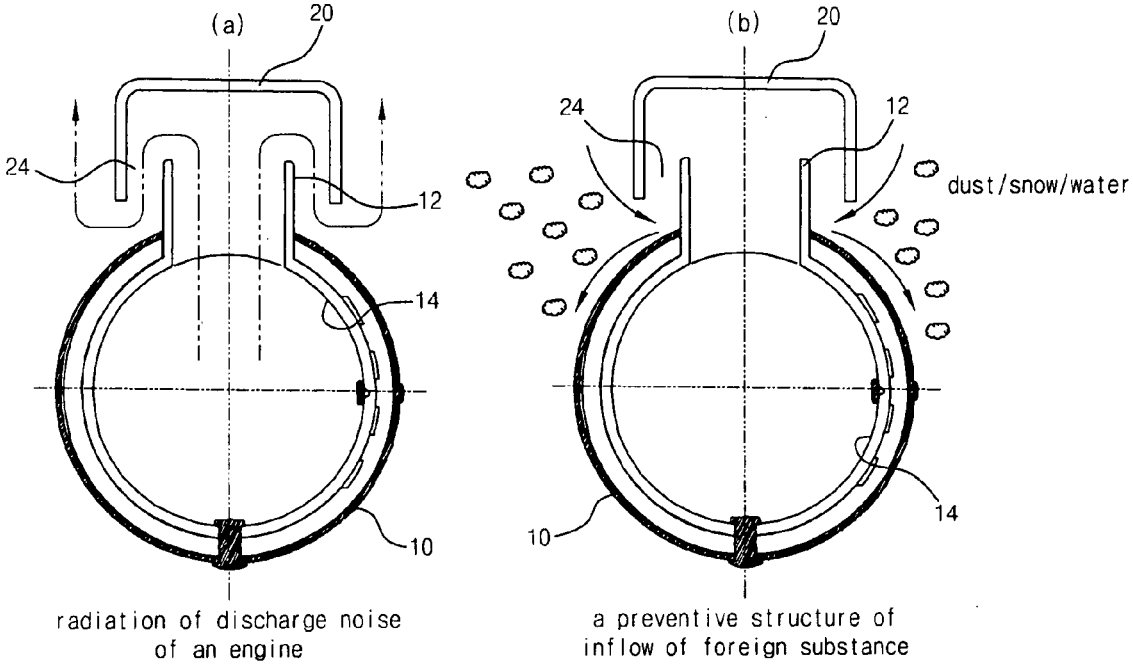
FIG. 5*b* is a sectional view illustrating a function of an air duct orifice for reducing low frequency noise according to the present invention.

Referring also to FIG. 5*b*, the two side surfaces of the orifice pipe 12 without engaging jaws 18 and the two side surfaces of the orifice cover 20 without combining holes 22 are spaced apart from each other to form a radiation path 24 of discharge noise of the engine transmitted from inside the air duct 10.

Figure 2:
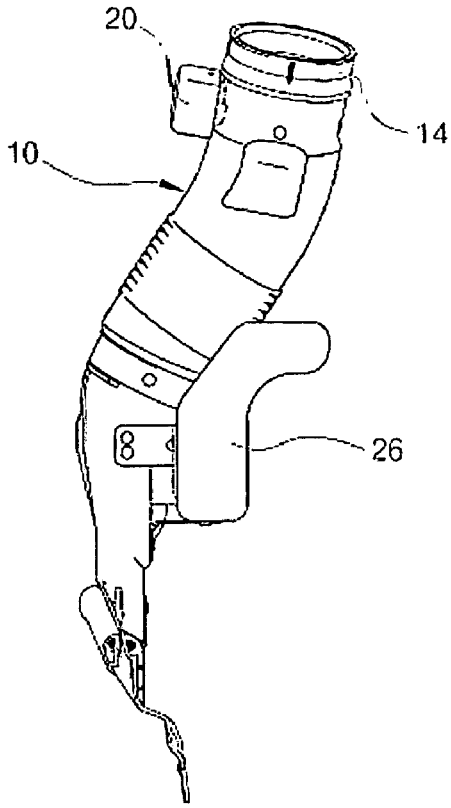
FIG. 2 is a perspective view, seen from another location, showing a structure of the air duct orifice for reducing low frequency noise according to the present invention.
Figure 3:
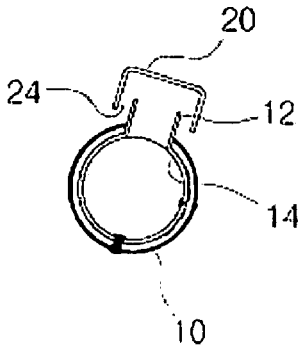
FIG. 3 is a sectional view taken along the line A—A in FIG. 1.
Figure 4:
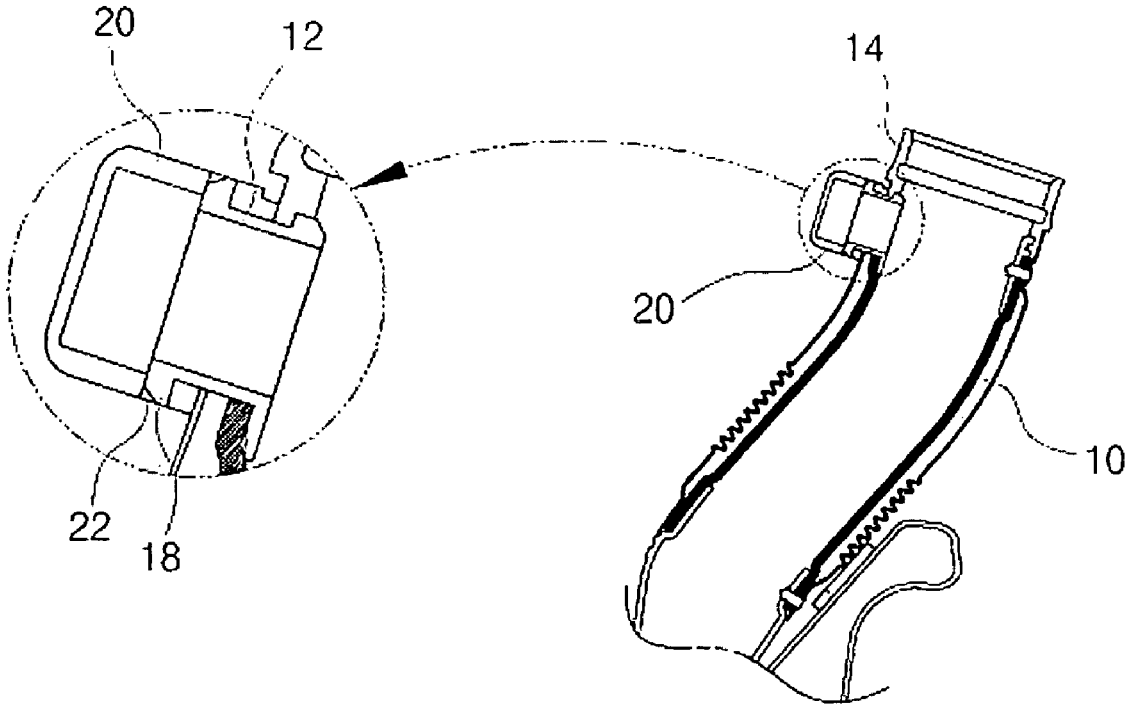
FIG. 4 is a sectional view taken along the line B—B in FIG. 1.

Referring again to FIGS. 1 and 2, in order to reduce resonance which is the specific frequency generated by the engine, a small resonator 26 of around 165 Hz is mounted to a lower surface of the air duct 10. The small size of resonator 26 offers advantages in layout when the engine is designed.

Operation of the air duct orifice of the exemplary embodiment described above is as follows:

As shown in FIG. 5*b*, when the noise discharged from the engine is transmitted to the external air intake port inside air duct 10, the noise passes through the interior of orifice pipe 12 and is guided and radiated to the exterior (that is, the engine room) through noise radiation passage 24.

Radiation passage 24 is a space formed upward and downward so that foreign substances cannot enter the radiation passage from outside.

Figure 6:
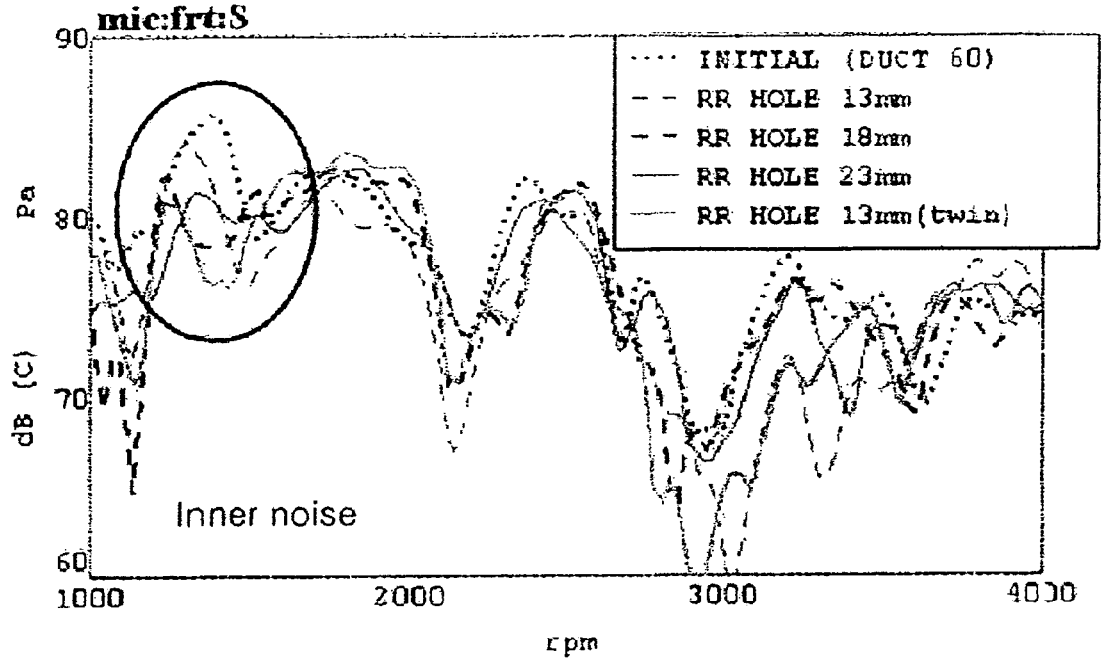
FIG. 6 is a graph showing a result of the field test of indoor noise and discharge noise of the air duct orifice for reducing low frequency noise according to the present invention.
Figure 6:
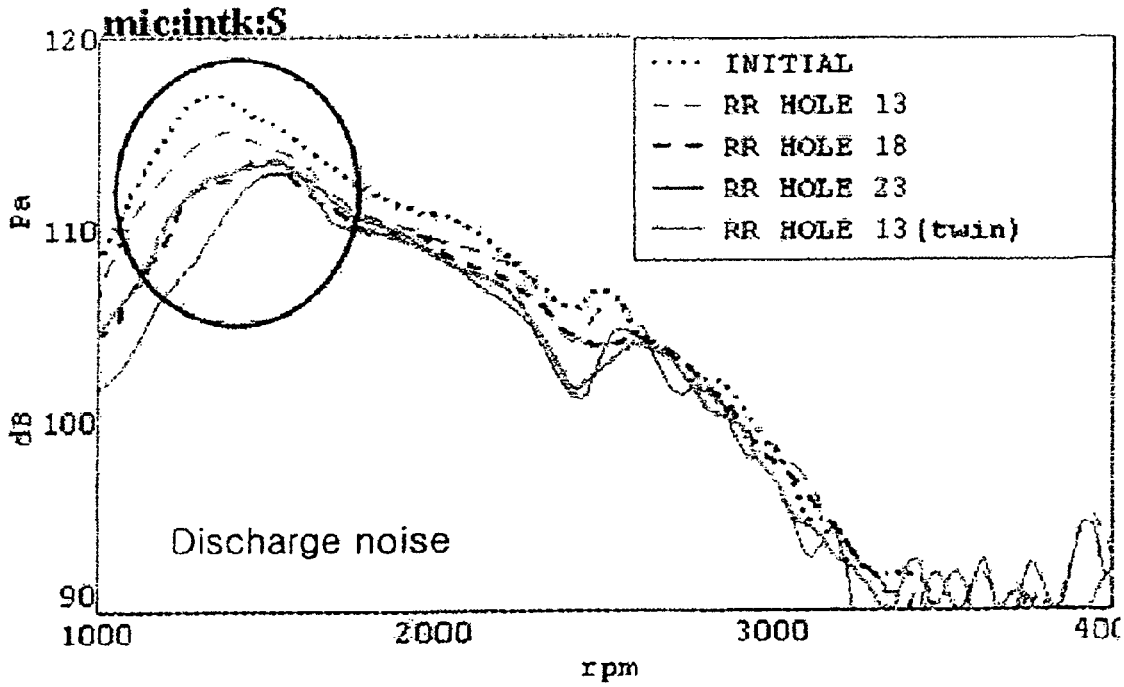
Figure 7:
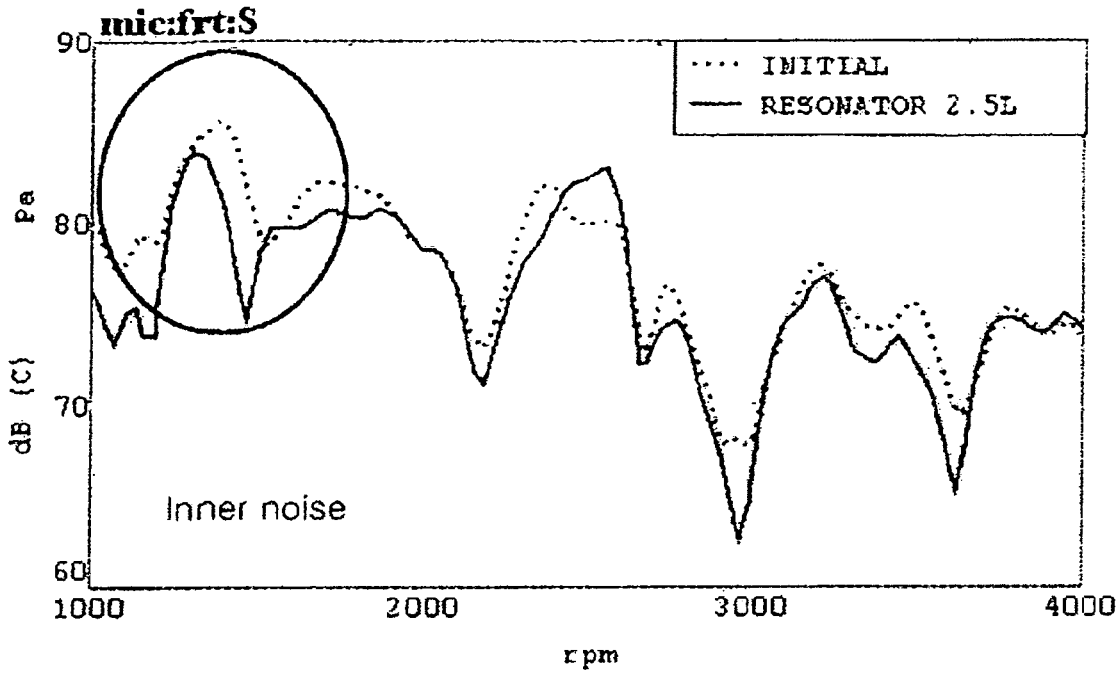
FIG. 7 is a graph showing a result of the field test of indoor noise and discharge noise when a resonator is installed in the air duct.
Figure 7:
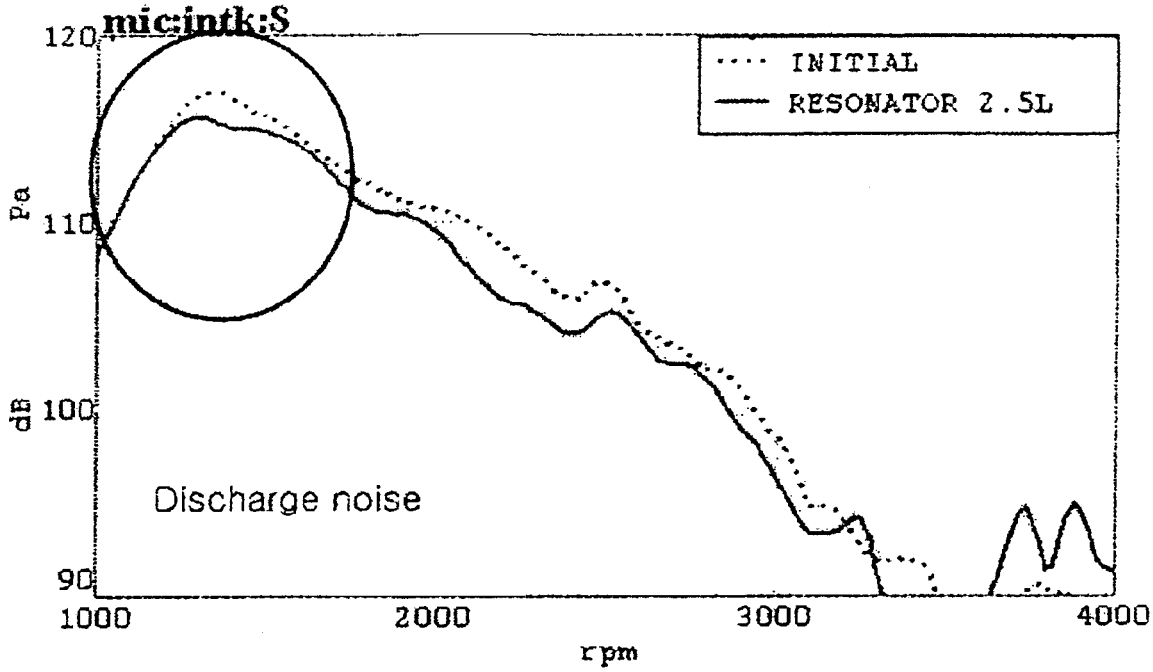

Field tests using the above-described air duct provided with an orifice pipe having a diameter of 13-23 mm were performed several times. The results of field tests are shown in the graph in FIG. 6. In the legend of FIG. 6, "RR" designates "rear," and "twin" refers to an orifice pipe having double holes.

As shown in FIG. 6, and referring especially to the circled portions, compared with a conventional structure ("initial") which is not provided with an orifice pipe, approximately 7 dB is reduced when the air duct provided with the orifice pipe is used.

Although exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An air duct orifice, comprising:

an adapter pipe attached to an end portion of an air duct connected to an engine; an orifice pipe protruding from a surface of the adapter pipe and comprising a first side surface and a second side surface; and an orifice cover coupled to an opening of the orifice pipe and comprising a first side surface and a second side surface;

wherein said first side surfaces and said second side surfaces are spaced apart from each other such that a gap is defined between the orifice pipe and the orifice cover, wherein the orifice pipe is in fluid communication with a surrounding ambient environment through the gap.

2. The air duct orifice as set forth in claim 1, wherein the air duct comprises a receiving opening at the end portion, whereby the orifice pipe is disposed in the receiving opening.

3. The air duct orifice as set forth in claim 1, wherein the orifice pipe comprises first and second engaging jaws on third and fourth side surfaces, respectively, and the orifice cover comprises first and second combining holes on third and fourth side surfaces, respectively, whereby the engaging jaws are engaged with respective ones of the combining holes.

4. The air duct orifice as set forth in claim 1, further comprising a resonator mounted to the air duct.

5. An air duct configured to be connected to an engine, comprising:

an adapter pipe attached to an end portion of the air duct;

an orifice pipe protruding from a surface of the adapter pipe and comprising a first side surface and a second side surface; and an orifice cover coupled to an opening of the orifice pipe and comprising a first side surface and a second side surface;

wherein said first side surfaces and said second side surfaces are spaced apart from each other such that a gap is defined between the orifice pipe and the orifice cover, wherein the orifice pipe is in fluid communication with a surrounding ambient environment through the gap.

6. The air duct as set forth in claim 5, further comprising a receiving opening at the end portion, whereby the orifice pipe is disposed in the receiving opening.

7. The air duct as set forth in claim 5, wherein the orifice pipe comprises first and second engaging jaws on third and fourth side surfaces, respectively, and the orifice cover comprises first and second combining holes on third and fourth side surfaces, respectively, whereby the engaging jaws are engaged with respective ones of the combining holes.

8. The air duct as set forth in claim 5, further comprising a resonator mounted to the air duct.

* * * * *